US005676488A

United States Patent [19]

Hedblom

[11] Patent Number: 5,676,488

[45] Date of Patent: Oct. 14, 1997

[54] PAVEMENT MARKING WITH MULTIPLE TOPCOATS

[75] Inventor: Thomas P. Hedblom, Eagan, Minn.

[73] Assignee: Minnesota Mining and Manufacturing Company, St. Paul, Minn.

[21] Appl. No.: 496,598

[22] Filed: Jun. 29, 1995

[51] Int. Cl.[6] ..... E01F 9/08

[52] U.S. Cl. ..... 404/9; 404/14; 404/20; 428/172; 428/173

[58] Field of Search ..... 404/9, 12, 14, 404/19, 20, 82, 16; 428/156, 172, 173

[56] References Cited

U.S. PATENT DOCUMENTS

| | | | |
|---|---|---|---|
| 3,436,359 | 4/1969 | Hubin et al. | 260/2 |
| 3,451,537 | 6/1969 | Freeman et al. | 206/59 |
| 3,580,887 | 5/1971 | Hubin et al. | 260/47 |
| 3,920,346 | 11/1975 | Wyckoff | 404/14 |
| 4,069,281 | 1/1978 | Eigenmann | 264/1 |
| 4,117,192 | 9/1978 | Jorgensen | 428/337 |
| 4,248,932 | 2/1981 | Tung et al. | 428/325 |
| 4,282,281 | 8/1981 | Ethen | 428/149 |
| 4,388,359 | 6/1983 | Ethen et al. | 428/143 |
| 4,443,510 | 4/1984 | Watt | 404/14 X |
| 4,490,432 | 12/1984 | Jordan | 428/220 |
| 4,530,859 | 7/1985 | Grunzinger, Jr. | 427/385.5 |
| 4,564,556 | 1/1986 | Lange | 428/325 |
| 4,681,401 | 7/1987 | Wyckoff | 404/14 X |
| 4,758,469 | 7/1988 | Lange | 428/325 |
| 4,937,127 | 6/1990 | Haenggi et al. | 428/148 |
| 4,969,713 | 11/1990 | Wyckoff | 350/109 |
| 4,988,541 | 1/1991 | Hedblom | 427/163 |
| 4,988,555 | 1/1991 | Hedblom | 428/172 |
| 5,006,010 | 4/1991 | Duckett | 404/9 X |
| 5,053,253 | 10/1991 | Haenggi et al. | 427/204 |
| 5,087,148 | 2/1992 | Wyckoff | 404/12 |
| 5,094,902 | 3/1992 | Haenggi et al. | 428/150 |
| 5,108,218 | 4/1992 | Wyckoff | 404/14 |
| 5,124,178 | 6/1992 | Haenggi et al. | 427/204 |
| 5,194,113 | 3/1993 | Lasch et al. | 156/243 |
| 5,227,221 | 7/1993 | Hedblom | 428/172 |
| 5,286,682 | 2/1994 | Jacobs et al. | 501/34 |
| 5,316,406 | 5/1994 | Wyckoff | 404/12 |
| 5,536,569 | 7/1996 | Lasch et al. | 404/14 X |
| 5,593,246 | 1/1997 | Hedblom et al. | 404/9 |

FOREIGN PATENT DOCUMENTS

| | | |
|---|---|---|
| 0 206 670 | 12/1986 | European Pat. Off. . |
| 2375394 | 8/1978 | France . |
| WO 96/06982 | 3/1996 | WIPO . |

OTHER PUBLICATIONS

Kirk–Othmer, Encyclopedia Chem. Tech., pp. 615–27, v. 23 (3d. Ed. 1983).

*Primary Examiner*—James Lisehora
*Attorney, Agent, or Firm*—Gary L. Griswold; Walter N. Kirn; Robert H. Jordan

[57] ABSTRACT

A pavement marking and a method of making a pavement marking, where retroreflectivity and skid-resistance can be independently controlled while making efficient use of the optical elements and skid-resistant particles. One illustrative embodiment includes two topcoats on a base sheet having first and second major surfaces, the first major surface having a plurality of protuberances located thereon which are separated by valleys. A first topcoat is attached to the first major surface of the base sheet and a second topcoat is selectively located on the protuberances. A first mixture of optical elements and/or skid-resistant particles is attached to, e.g., partially embedded in, the first topcoat and a second mixture of optical elements and/or skid-resistant particles is attached to, e.g., partially embedded in, the second topcoat.

23 Claims, 4 Drawing Sheets

PAVEMENT MARKING WITH MULTIPLE TOPCOATS

FIELD OF THE INVENTION

The present invention pertains to pavement markings including optical elements and/or skid-resistant particles. More particularly, the present invention relates to pavement markings to which optical elements and skid-resistant particles are selectively secured in different topcoat layers and methods of manufacturing such pavement markings.

BACKGROUND OF THE RELATED ART

Pavement markings are used on roadways to display traffic lanes and other traffic information to motor vehicle drivers. Very often pavement markings are retroreflective so that motor vehicle drivers can vividly see the markings at nighttime. Retroreflective pavement markings have the ability to return a substantial portion of incident light towards the source from which the light originated. Light from motor vehicle headlamps is returned toward the oncoming vehicle to illuminate, e.g., the boundaries of the traffic lanes for the motor vehicle driver.

In view of the important purpose served by pavement markings, investigators have continuously attempted to make various improvements to them. Indeed, the pavement marking art is replete with patented disclosures; see for example U.S. Pat. Nos.: 5,286,682, 5,227,221, 5,194,113, 5,087,148, 4,988,555, 4,969,713, 4,490,432, 4,388,359, 4,988,541, 4,490,432, 4,388,359, and 4,117,192, all of which are hereby incorporated by reference. Known retroreflective pavement markings typically include a rubber base sheet that contains pigments and fillers. Optical elements and/or skid-resistant particles are typically secured to a base sheet by being embedded therein or are secured thereto by a bonding material or binder. Pigments and fillers typically are dispersed throughout the base sheet for a number of reasons, including reducing cost, improving durability, and providing conformability. Pigments have also been placed in the bonding material to enhance visibility of the pavement marking and as part of the retroreflective mechanism.

When the pavement marking is retroreflective, it may include a raised pattern of protuberances on the upper surface of the base sheet to elevate the optical elements above any water or other liquids on the roadway, thereby enhancing reflectivity of the pavement marking under wet conditions; see, for example, U.S. Pat. Nos. 5,227,221, 5,087,221, 5,087,148, 4,969,713, and 4,388,359, all of which are hereby incorporated by reference.

Light that is incident upon a typical retroreflective pavement marking is retroreflected in the following manner. First, the incident light passes through and is refracted by the optical elements to strike the pigments in the base sheet or in the bonding material. The pigments then scatter the incident light, and the optical elements redirect a portion of the scattered light back in the direction of the light source.

Typical skid-resistant particles do not play a role in retroreflectivity; they are disposed on retroreflective and non-retroreflective pavement markings to improve dynamic friction between the marking and a vehicle tire.

The pavement markings disclosed in U.S. Pat. Nos. 5,227,221, 4,988,555, and 4,988,541 (referred to collectively as "the Hedblom patents") are all incorporated by reference, and represent advances in the art by making very efficient use of the optical elements and/or skid-resistant particles. This is accomplished by using a patterned base sheet and selectively applying a bonding material to the protuberances so that the optical elements and/or skid-resistant particles are secured exclusively to the protuberances where they are most effective.

The optical elements and/or skid-resistant particles are substantially absent from the valleys where they make little contribution to the retroreflective performance or the skid-resistance of the pavement marking. By selectively securing the optical elements and skid-resistant particles to the protuberances, fewer optical elements and fewer skid-resistant particles can be employed without sacrificing retroreflective performance and skid resistance.

Although the pavement markings disclosed in the Hedblom patents demonstrate good retroreflectivity and good skid resistance, and make efficient use of the optical elements and skid-resistant particles, it has been found that the fillers in the rubber base sheet have become present on the base sheet's front surface after the pavement marking has been exposed to the sun for an extended period of time. When a substantial quantity of fillers are present on the front surface of the base sheet, the pavement marking displays a white or chalky color. The presence of the fillers on the base sheet becomes problematic when the pavement marking is intended to display a color other than white. When the pavement marking has a color distinct from white—for example, red, green, blue, or black—the pavement marking's intended color can become severely diluted by the presence of the fillers. This problem is exceptionally severe in climates where the pavement markings are subject to intense exposure to the sun. In southern locations of the United States of America, red pavement markings have turned a pinkish color after being exposed to the sun for a few months.

In addition, typical patterned pavement markings include closely-spaced protuberances. As a result, contact between a tire and the valleys located between protuberances may be minimal or nonexistent. Therefore, it has been considered advantageous to place the skid-resistant particles on the protuberances along with the optical elements, thereby ensuring contact between the skid-resistant particles and a tire.

One disadvantage to placing both optical elements and skid-resistant particles on the protuberances is that the space on the protuberances is limited. As a result, applying the skid-resistant particles on the same areas as the optical elements results in a compromise between skid-resistance and reflectivity, i.e., as more optical elements are applied, there is less space for bonding skid-resistant particles to the pavement marking and vice versa. Up to a certain level, the retroreflectivity of the pavement marking is generally related to the number of optical elements located on the protuberances and skid resistance is generally related to the number of skid-resistant particles on the protuberances. As a result, reflectivity and skid-resistance cannot both be optimized in pavement markings in which both the optical elements and the skid-resistant particles are located on the protuberances because of the limited space available on the protuberances.

SUMMARY OF THE INVENTION

The present invention provides a new pavement marking and a new method of making a pavement marking, where retroreflectivity and skid-resistance can be independently controlled while making efficient use of the optical elements and skid-resistant particles.

One illustrative embodiment of a pavement marking including two topcoats comprises a base sheet having first and second major surfaces, the first major surface having a plurality of protuberances located thereon which are separated by valleys. A first topcoat is attached to at least a portion of the first major surface of the base sheet and a second topcoat is selectively located on the protuberances. A first mixture of optical elements and/or skid-resistant particles is attached to, e.g., partially embedded in, the first topcoat and a second mixture of optical elements and/or skid-resistant particles is attached to, e.g., partially embedded in, the second topcoat.

One illustrative method of manufacturing a pavement marking including two topcoats comprises providing a substantially planar base sheet and applying a first topcoat to the first major surface of the base sheet; forming a plurality of protuberances in the base sheet and first top coat, the protuberances being separated by valleys; selectively applying a second topcoat to the protuberances; bonding a second mixture of optical elements and/or skid-resistant particles to the second topcoat; and bonding a first mixture of optical elements and/or skid-resistant particles to the first topcoat.

Pavement markings according to the invention differ from known patterned pavement markings in that a first topcoat is disposed on the first major surface of the base sheet at least in the valleys and a second topcoat is selectively located on the protuberances. Additional layers of topcoats may also be provided as desired. By bonding desired mixtures of optical elements and/or skid-resistant particles to the different topcoats, the optical and skid-resistant properties of the pavement marking can be independently controlled.

In one illustrative embodiment of a pavement marking including two topcoats, a mixture comprising primarily optical elements is bonded to the second topcoat which is itself selectively located on the protuberances of the pavement marking. As a result, the optical elements can be effectively and efficiently exploited to enhance retroreflectivity of the pavement marking. Likewise, by attaching a mixture comprising primarily skid-resistant particles to the first topcoat, their properties are also most effectively exploited to enhance skid-resistance of the pavement marking.

A further advantage of the present invention is that the first and second topcoats effectively cover the entire first surface of the base sheet, which reduces oxidation of the rubber base sheet due to exposure to ultra-violet (UV) light. By so covering the base sheet, the pavement makings may more effectively retain their intended color after being exposed to the sun for extended periods of time and, therefore, are particularly advantageous for use in climates where exposure to the sun is intense. Reducing oxidation is especially useful when a color other than white is intended to be displayed by the pavement marking.

In one illustrative embodiment employing two topcoats, the first topcoat is a thermoplastic material and the second topcoat is a thermosetting material. By exploiting the opposing properties of those materials, pavement markings according to the present invention can be easily produced and exhibit favorable properties to enhance their adhesion to road surfaces.

In one illustrative method for manufacturing a pavement marking having two topcoats, a thermoplastic layer is laminated to a rubber base sheet. The laminate is then embossed to form the desired protuberances in a process which ensures that the thermoplastic layer remains at least in the valleys and, potentially, over the protuberances as well. The protuberances are then coated with the thermosetting material after which a second mixture of optical elements and/or skid-resistant particles are bonded to the thermosetting material. Due to the properties of the thermoplastic, the second mixture of optical elements and/or skid-resistant particles are essentially all located in the uncured the thermosetting material. The pavement marking is then heated to simultaneously cure the thermosetting material and prepare the thermoplastic material to accept and retain the first mixture of optical elements and/or skid-resistant particles.

The optical elements and/or skid-resistant particles in the first mixture are not bonded to the protuberances for at least two reasons. The first mixture is preferably introduced after the thermosetting material is at least partially cured, thereby reducing its bonding potential. Also, by introducing the second mixture of optical elements and/or skid-resistant particles when the thermosetting material is freshly coated (i.e., substantially uncured), the optical elements and/or skid-resistant particles in the second mixture may occupy substantially all of the "real estate" coated with the thermosetting material. As a result, when the first mixture is introduced, there may be little or no room on the thermosetting material to accept the optical elements and/or skid-resistant particles of the first mixture.

Those skilled in the art will understand that the location of the thermosetting and thermoplastic materials could be reversed while retaining many of the advantages of the present invention. The thermosetting material is, however, preferably limited to the protuberances because it is typically stiffer than a thermoplastic and limiting its location to the protuberances enhances flexibility of pavement markings according to the present invention.

The advantages of providing an oxidation-reducing topcoat over the entire first surface of the base sheet while retaining sufficient flexibility are particularly important in embodiments of pavement markings according to the present invention in which the protuberances are spaced apart to enhance retroreflectivity by reducing "blocking" or "shadowing" from neighboring protuberances. In such embodiments, the area occupied by valleys is substantially larger than in typical patterned pavement markings, thereby increasing the negative effects of oxidation in the valleys. Furthermore, the placement of skid-resistant particles in those valleys while maximizing placement of the optical elements on the protuberances is especially useful because both properties, i.e., skid-resistance and retroreflectivity, can be optimized without degrading the other property.

These and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

The figures are idealized and are not drawn to scale.

DETAILED DESCRIPTION OF ILLUSTRATIVE EMBODIMENTS

In the practice of the present invention, a pavement making is provided that makes efficient use of both optical elements and skid-resistant particles.

Pavement markings according to the present invention include a selected configuration of upright protuberances which rise above the top surface of a base sheet which is applied to a roadway. The protuberances need not necessarily be regularly shaped, sized, or spaced-apart. However, the present invention is perhaps most easily understood and explained with reference to the embodiments described herein in which the protuberances are regularly shaped and spaced.

One configuration of protuberances is designed to minimize shadowing of adjacent protuberances (in the line of sight of a driver) by spacing the protuberances further apart as well as offsetting them laterally (with respect to the line of sight of the driver) than is typical in many conventional pavement markings. Such configurations are described more completely in commonly-assigned U.S. patent application Ser. No. 08/247,050, filed on May 20, 1995, titled PATTERNED PAVEMENT MARKING WITH UPRIGHT RETROREFLECTORS, which is hereby incorporated by reference.

Figure 1:
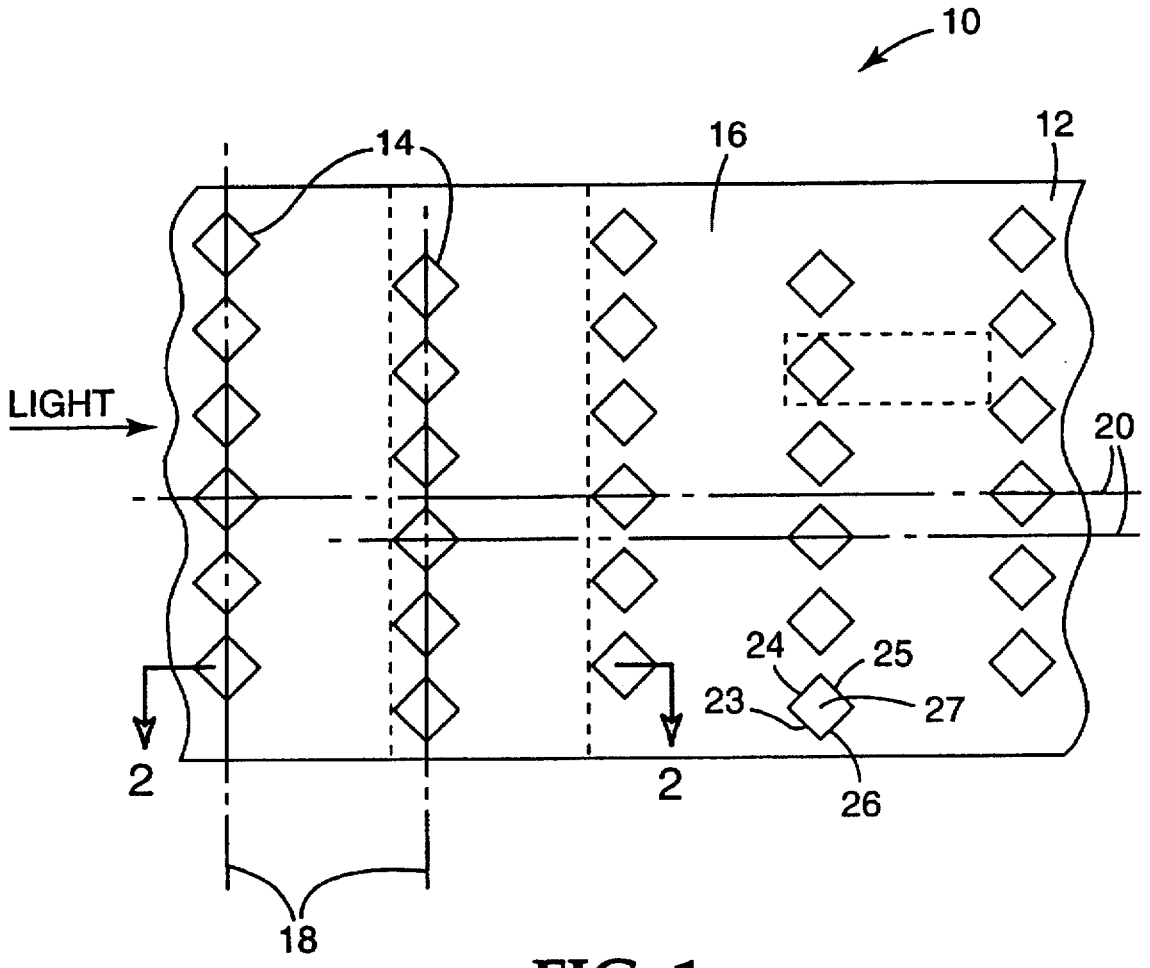
FIG. 1 illustrates a top view of an illustrative pavement marking 10 in accordance with the present invention.

With reference to FIG. 1, one retroreflective pavement marking 10 according to the invention includes a base sheet 12 that has a plurality of protuberances 14 located thereon. Valleys 16 separate adjacent protuberances 14 and provide an area for placement of skid-resistant particles and water to reside in the event rain falls on the pavement marking. The protuberances 14, which are elevated above the valleys 16, preferably contain primarily optical elements and, being raised, allow light transmission to and from the pavement marking to occur without being impaired by the presence of water.

As illustrated in the embodiment depicted in FIG. 1, the protuberances 14 are typically arranged on the base sheet 12 in a predetermined pattern. The protuberances 14 shown in FIG. 1 generally have a square outline defined by four side surfaces 23, 24, 25, and 26, that meet at a top surface 27. The length of each side surface 23–26, typically is about 4 to 10 millimeters (mm), more typically about 6 mm. Although the protuberances 14 depicted in FIG. 1 have a square outline, it will be understood that the protuberances 14 could take any desired shape, including, but not limited to: circular, oval, polygonal, etc.

The columns 18 of protuberances 14 are spaced apart, typically, at a distance of about 15–35 mm, more typically at a distance of about 25 mm. As used herein, the columns 18 will typically be oriented substantially perpendicular to the expected direction of light desired to be retroreflected, i.e., the direction from which traffic approaches.

Perpendicular to the columns 18, adjacent rows 20 can be identified which extend essentially parallel to the direction of light to be retroreflected. The spacing between adjacent rows 20 is typically about 4–10 mm, more preferably about 6–8 mm.

In the embodiment depicted in FIG. 1, the protuberances 14 located in a row 20 appear in every other column 18, i.e., adjacent columns 18 do not contain protuberances 14 in the same rows. This "lateral offset" between the protuberances 14 in adjacent columns 18 enhances retroreflectivity by minimizing shadowing or blocking. It will be understood that spacing of the protuberances may also be based on the height of the protuberances as measured above the valley 111 of pavement marking 10, as the height will also affect shadowing or blocking.

Although one pattern of protuberances 14 is depicted in FIG. 1, it will be understood that many other patterns providing increased valley area could be used. In particular, the adjacent columns may not be laterally offset where shadowing is a lesser concern and the spacing between adjacent protuberances 14 in a row can be modified where desired. Likewise, spacing between adjacent columns 18 could also be increased or decreased if desired.

The pattern depicted in FIG. 1, in addition to minimizing shadowing or blocking, also provides increased valley 16 area which can be used for skid-resistant particles 36 in some embodiments as discussed below with reference to FIG. 2. The increased valley provides for contact between a vehicle tire and any skid-resistant particles 36 which are located in the valley 16. The contact between a tire and the skid-resistant particles provides the desired friction to reduce skidding over the pavement marking 10.

Figure 2:
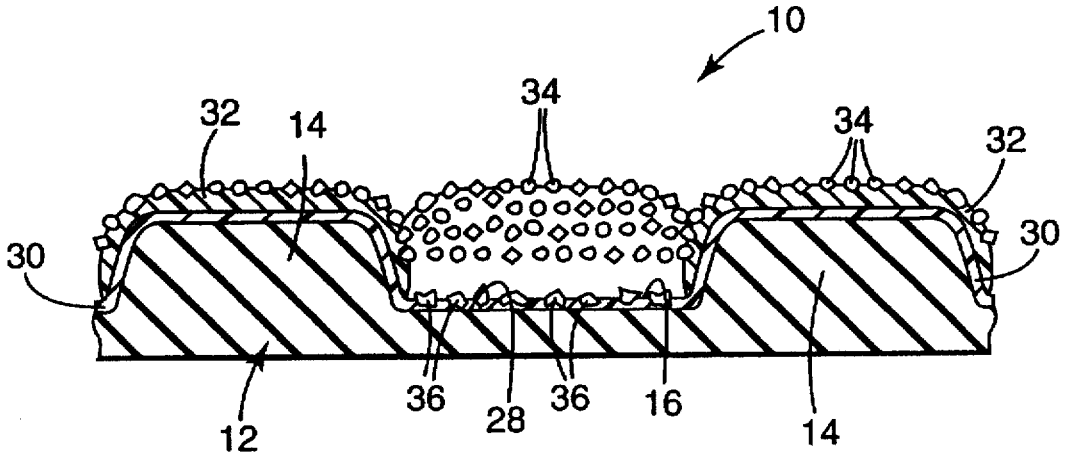
FIG. 2 illustrates a cross-section of pavement marking 10 of FIG. 1 taken along line 2—2.

FIG. 2 illustrates in cross-section a portion of a retroreflective pavement marking 10. As shown, pavement marking 10 includes a base sheet 12 that has protuberances 14 protruding from a first major surface or front side 28 of the base sheet 12. Located between adjacent protuberances 14 is a valley 16 also disposed on the front side 28 of base sheet 12.

In one embodiment, the base sheet 12 has a total thickness of about 1 to 5 mm, more typically about 2 mm. The protrusions 14 typically have a height of about 0.5 to 3 mm, more typically about 1 mm. Pavement markings having base sheet thicknesses and protuberance heights outside of these ranges may be made in accordance with the present invention if desired.

In the embodiment shown, the top surface 27 of the protrusions 14 meets with each of the side surfaces 23–26 at a rounded interface. Each of the side surfaces 23–26 may form an angle of about 70°–72° with the plane of the base sheet 12, although other angles may be used as desired based on expected direction of light to be retroreflected.

As shown, the protuberances 14 are preferably, but not necessarily, formed as an integral part of the base of the base sheet 12; that is, as one single unit and not two separate parts subsequently joined together. A first topcoat layer 30 is disposed at least in the valley 16 between the protuberances 14, but as shown, is also preferably disposed over the protuberances 14 to form a substantially continuous layer on the front side 28 of base sheet 12.

A second topcoat layer 32 is selectively located on the protuberances 14 so as to be substantially absent from the valleys 16. As shown in FIG. 2, the second topcoat 32 may be located over the entire protuberance 14, i.e., over the top surface 27 as well as the side surfaces 23–26.

In the embodiment depicted in FIG. 2, a plurality of primarily optical elements 34 are secured to the protuberances 14 by the second topcoat 32 and, because the second topcoat 32 is selectively located on the protuberances 14, essentially none of the optical elements 34 are located in the valleys 16.

As indicated above, the first topcoat layer 30 is located and exposed in the valley 16. In the embodiment depicted in FIG. 2, the first topcoat layer 30 is also located on the protuberances 14, but is covered there by the second topcoat layer 32 so as to be unexposed. In the valley 16 where the first topcoat 30 is exposed, it is used to bond a plurality of primarily skid-resistant particles 36 to the base sheet 12.

By selectively bonding primarily optical elements 34 to the second topcoat layer 32 and primarily skid-resistant particles 36 to the first topcoat layer 30, the optical and skid-resistant properties of the pavement marking 10 can be independently controlled. In the embodiment depicted in FIG. 2, if additional skid-resistance is desired, additional or different skid-resistant particles 36 can be added without occupying the limited space on the protuberances 14. By placing primarily optical elements 34 on the protuberances 14, the maximum number of optical elements 34 can be located there where they are most effective. As a result, the retroreflectivity of the pavement marking 10 can be enhanced without limiting the skid-resistance of the pavement marking 10.

Although the embodiment depicted in FIG. 2 includes primarily optical elements 34 on the protuberances 14 and primarily skid-resistant particles 36 in the valley 16, alternate embodiments may include desired mixtures of the optical elements 34 and skid-resistant particles 36 on the protuberances 14 and in the valley 16. To optimize retroreflectivity and skid resistance, it may be desirable to have a first mixture located in the valley 16 attached to the first topcoat 30 and a second mixture located on the protuberances 14 and attached to the second topcoat 32. In some instances, the first mixture may be substantially skid-resistant particles 36 while the second mixture may be substantially optical elements 34. In other instances, the mixtures may be more heterogeneous and may even comprise different types of optical elements 34 and different types of skid-resistant particles 36.

Figure 3:
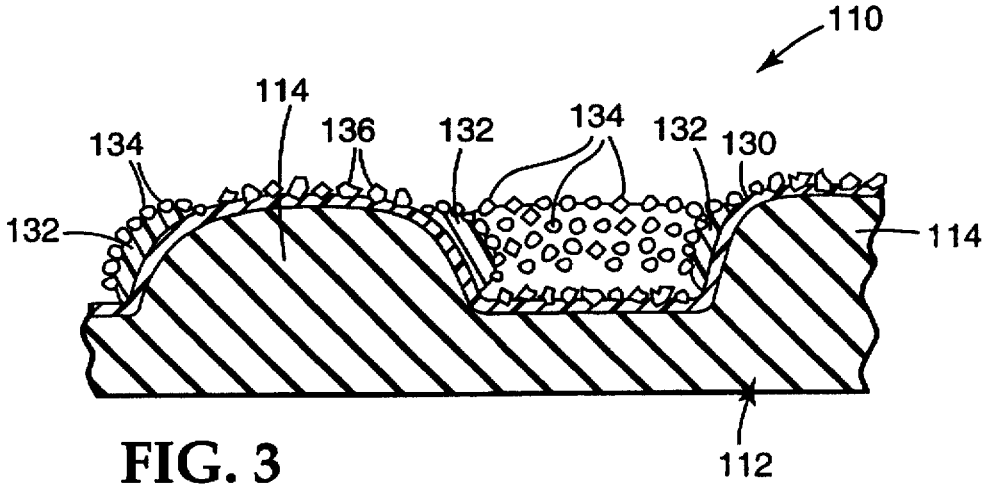
FIG. 3 illustrates a cross-section of an alternate illustrative pavement marking 110 in accordance with the present invention.

Turning to FIG. 3, an alternate embodiment of a pavement marking 110 according to the present invention is shown in a schematic cross-sectional view. Pavement marking 110 varies from that depicted in FIG. 2 in that the second topcoat layer 132 is selectively disposed only on the sides of the protuberances 114. As a result, optical elements 134 are also located only on the sides of the protuberances 114. Skid-resistant particles 136 may then be located on the top surface (see ref. no. 27 in FIG. 1) of each of the protuberances 114 as well as in the valley 116 of the pavement marking 110, thereby enhancing its skid-resistant properties.

Figure 4:
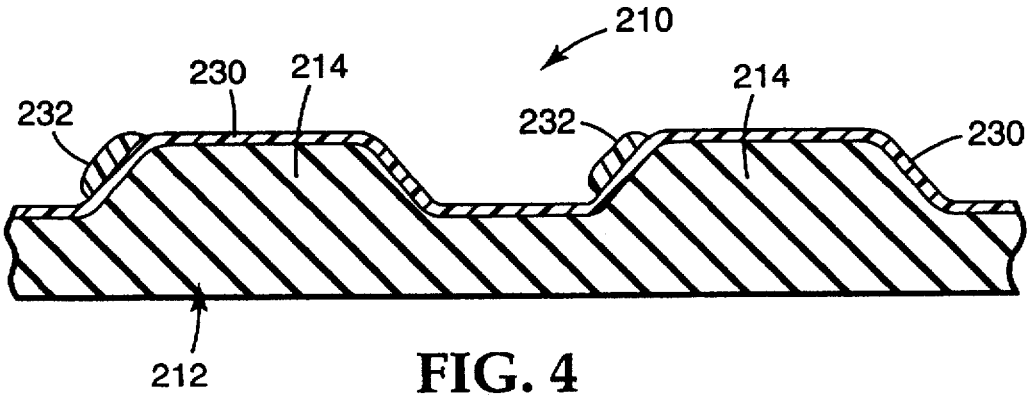
FIG. 4 illustrates a cross-section of another alternate illustrative pavement marking 210 in accordance with the present invention.

FIG. 4 depicts yet another embodiment of a pavement marking 210 according to the present invention in which the second topcoat layer 232 is located on only a portion of the side of each protuberance 214. As a result, optical elements 234 and/or skid-resistant particles 236 can be selectively located on only corresponding portions of the protuberances 214. A further variation in this embodiment can be made by providing the first topcoat 230 in one color and the second topcoat 232 in a second color, e.g., by selection of appropriately colored pigments. The result would be that the pavement marking 210 would retroreflect the first color when approached from one direction and the second color when approached from a second direction (assuming that both topcoats included retroreflective elements. This may help inform drivers of important information, such as when traveling in the wrong direction on a one-way road. If desired, a second topcoat (not shown), formulated to a different color, could be provided on other portions of the protrusions.

Suitable base sheets 12 for this invention may be formed using known methods and materials, such as described in U.S. Pat. Nos. 4,388,359 and 4,490,432; both of which are incorporated herein by reference. The embossed rubber base sheet 11 may comprise elastomer precursors, not yet vulcanized or cured, which therefore permit viscoelastic deformation. Exemplary materials include acrylonitrile-butadiene polymers, millable urethane polymers and neoprenes. Illustrative examples of other rubber materials that may be employed in the base sheet include styrene-butadiene block copolymers, natural rubber, chlorobutadiene, polyacrylates, carboxyl-modified acrylonitrile-butadienes (see U.S. Pat. No. 4,282,281 incorporated here by reference). Extender resins—preferably halogenated polymers such as chlorinated paraffins, but also hydrocarbon resins or polystyrenes—preferably are included with the non-crosslinked elastomer precursor ingredients and are miscible with, or form a single phase with, the elastomer precursor ingredients. Thermoplastic reinforcing polymers preferably are dispersed in the elastomer precursor as a separate phase. Suitable thermoplastic reinforcing polymers include polyolefins, especially polyethylene, vinyl copolymers, polyethers, polyacrylates, polyurethanes, styrene-acrylonitrile copolymers and cellulose derivatives.

In addition to the rubber component, the base sheet 12 also preferably includes fillers. As the term is used herein, "fillers" means an inert inorganic mineral material, typically in powder form, that is contained in the interior of the base sheet. The fillers may be included in the base sheet for a number of reasons, for example, to alter stiffness, to decrease cost, and to improve surface hardness and abrasion resistance. Examples of fillers that may be added to the base sheet include talc, mica, white pigments such as $TiO_2$ (white pigments are designated in the Colour Index as pigment whites under the notation "P.W."), silicates, glass beads, calcium carbonate, carbon black, asbestos, barytes, blanc fixe, slate flour, soft clays, et cetera. Most common fillers are $TiO_2$, $SiO_2$, and talc. The fillers typically are added to the base sheet at about 50 to 80 percent by weight, more typically at about 60 to 75 percent by weight, based on the weight of the base sheet.

As indicated above, the invention is also suitable for pavement markings that display a daytime color other than white as discussed in commonly-assigned U.S. patent application Ser. No. 08/296,677, filed on Aug. 26, 1994, titled PATTERNED CHALK-RESISTANT PAVEMENT MARKING, which is hereby incorporated by reference. The topcoat materials, which are described in more detail below, may also provide resistance to oxidation, as well as serving as a means of bonding optical elements 34 and skid-resistant particles 36 to the pavement marking 10.

Generally, suitable materials for the first and second topcoats 30 and 32 are preferably characterized by excellent adhesion to the optical elements and/or skid-resistant particles, which are typically partially embedded in the topcoat materials. Additionally, the first topcoat materials preferably strongly bond to the base sheet 12 and the second topcoat materials strongly bond to the first topcoat material and/or the base sheet 12 depending on the exact construction of the pavement marking 10. Both topcoats are preferably highly cohesive and resistant to environmental weathering.

Typically, the first topcoat layer 30 is present on the pavement marking 10 at a thickness of about 0.1–0.5 mm, more preferably about 0.2 mm. The second topcoat layer 32 is present on the pavement marking 10 at a thickness of about 0.1–0.5 mm, more preferably 0.3 mm. In either case, the thickness of the topcoats should be sufficient to firmly bond the optical elements 34 and the skid-resistant particles 36 to the pavement marking 10. It will be understood that thicknesses outside these ranges may be used if desired.

Optical elements 34 suitable for use in the invention include glass microspheres (also known as beads or retroreflective beads) formed of glass materials having indices of refraction of from about 1.5 to about 1.9. As is well known in the art, glass microspheres of material having an index of refraction of about 1.5 are less costly and more durable than glass microspheres of material having an index of refraction of from about 1.75 to about 1.9; however, the less expensive, durable glass microspheres can be less effective retroreflectors.

The microspheres preferably have a diameter compatible with the size, shape, spacing and geometry of the protuberances present on the base sheet. Typically, microspheres of from 50–350 m in diameter may be suitably employed. Other factors affecting element size are the number of rows of beads desired to be available to vehicle headlights. See the Hedblom patents for more detailed discussions.

Optical elements 34 useful in the present invention are disclosed in U.S. Pat. Nos. 4,564,556 and 4,758,469, which are incorporated here by reference and are generally described therein as solid, transparent, non-vitreous, ceramic spheroids comprising at least one crystalline phase containing of at least one metal oxide. The ceramic spheroids also may have an amorphous phase such as silica. The term non-vitreous means that the spheroids have not been derived from a melt or mixture of raw materials capable of being brought to a liquid state at high temperatures, like glass. The spheroids are resistant to scratching and chipping, are relatively hard (above 700 Knoop hardness), and are made to have a relatively high index of refraction (ranging between 1.4 and 2.6). These optical elements may comprise zirconia-alumina-silica and zirconia-silica.

Further, it will be understood that other optical elements 34 such as plastic or ceramic microspheres may be used if desired and that the present invention is not to be limited to the use of glass optical elements.

The skid-resistant particles 36 can be, for example, ceramics such as quartz or aluminum oxide or similar abrasive media. Skid-resistant particles may also include fired ceramic spheroids having a high alumina content such as taught in U.S. Pat. Nos. 4,937,127, 5,053,253, 5,094,902, and 5,124,178 to Haenggi et al., incorporated here by reference. The particles do not shatter upon impact like crystalline abrasive media such as $Al_2O_3$ and quartz. Skid-resistant particles typically have sizes of about 300 to 800 micrometers.

The present invention exploits the differing properties of the materials used for the first and second topcoats 30 and 32 to provide a method of manufacturing a pavement marking 10 according to the present invention which can be manufactured in a single pass through the appropriate equipment.

In one illustrative embodiment, one of the topcoats is preferably a thermoplastic material while the other topcoat is a thermosetting material. As a result, the thermosetting material can be applied uncured and either the optical elements 34 or the skid-resistant particles 36 can be applied to the uncured thermosetting material without bonding to the thermoplastic material because it is in a substantially solid state. Furthermore, a substantial majority of the open surface of the thermosetting material be covered by the optical elements 34 and/or skid-resistant particles 36.

After the mixture of optical elements 34 and/or skid-resistant particles 36 have been applied to the thermosetting material, the process of curing the thermosetting material by heating can begin. That same heating process also serves to prepare the thermoplastic material to receive optical elements 34 and/or skid-resistant particles 36. Although a few stray particles may attach themselves to the thermosetting material if it is not completely cured at the time of introduction of particles onto the thermoplastic material, such mislocations can be minimized by ensuring that as much of the surface of the thermosetting material as possible is taken up by particles when the thermosetting material was uncured.

As described below, the illustrative methods and resulting pavement markings provide a first topcoat 30 which is a thermoplastic material located over substantially the entire marking 10 and a second topcoat 32 which is a thermosetting material located on the protuberances 14. One reason for this preference is that, typically, thermoplastic materials are more flexible than thermosetting materials. Because the spacing of protuberances 14 results in a substantial amount of valley 16, the first topcoat 30 is located over a substantial portion of the base sheet 12, using a thermoplastic material for the first topcoat 30 will generally provide a more flexible pavement marking 10 which is better able to conform to irregular roadway surfaces and will wear better as traffic moves over the pavement marking 10.

Figure 5:
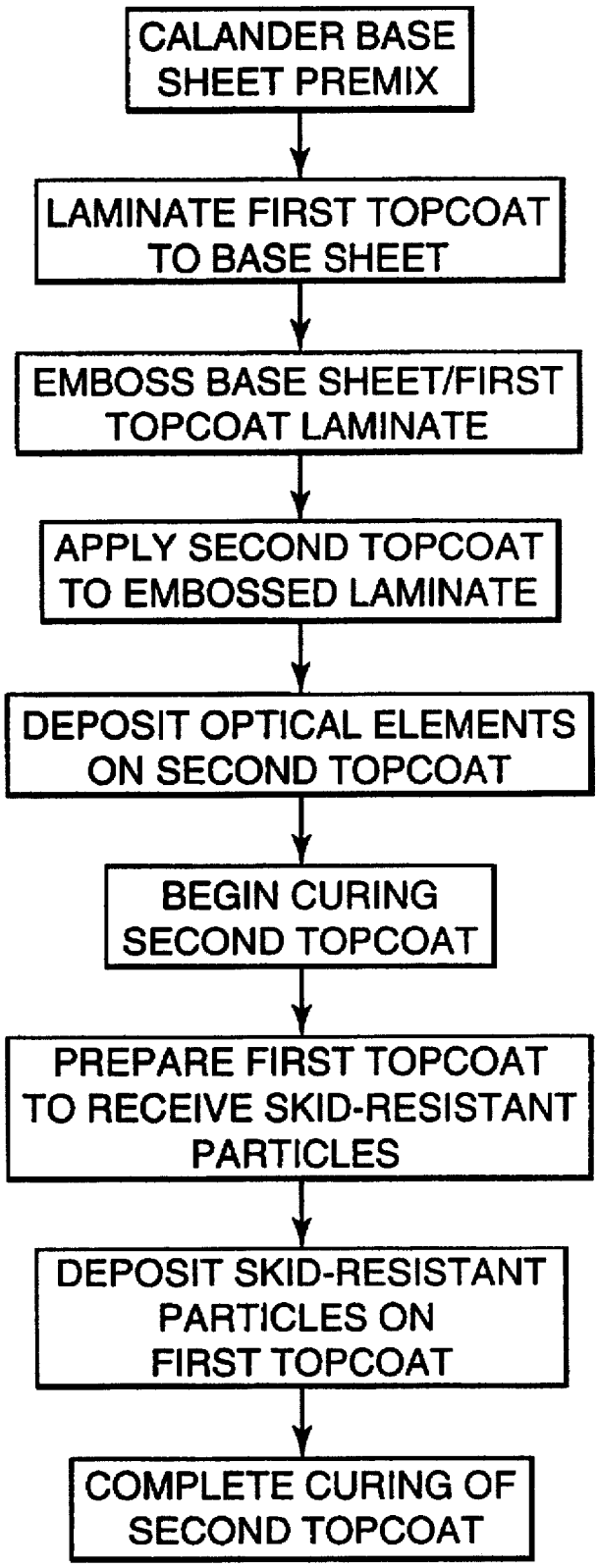
FIG. 5 is a flow chart depicting one method of manufacturing a pavement marking according to the present invention.

FIG. 5 is a flowchart generally illustrating one method of manufacturing a pavement marking according to the present invention. A more detailed discussion of one illustrative method is presented below.

The first step in that process involves calendaring the base sheet premix according to known methods. The first topcoat 30 (preferably a thermoplastic) may be laminated to the base sheet 12 during the calandering operation. After lamination, the base sheet 12 and first topcoat 30 are embossed to form the protuberances 14 on the first surface of the pavement marking 10. Alternately, the base sheet 12 may be formed and embossed first, after which the topcoat 30 can be applied, e.g., laminated or coated, to the embossed base sheet 12 in a process in which the topcoat 30 conforms to the shape of the base sheet 12.

Although not required, it may be desirable to include one or more "tie" layers between the base sheet 12 and the first topcoat 30 to enhance adhesion between the base sheet and first topcoat. Such tie layers and their use are described in U.S. Pat. No. 5,194,113, which is incorporated by reference, and, as a result, they will not be described in more detail here.

After the embossed laminate 11 (consisting of the base sheet 12 and first topcoat 30) is formed, the second topcoat material (preferably a thermosetting material) can be applied to the protuberances 14. Methods of coating protuberances such as those considered within the present invention are described in, for example, U.S. Pat. No. 4,988,555 to Hedblom, which is incorporated by reference.

After the uncured thermosetting second topcoat is in place, the second mixture of optical elements 34 and/or skid-resistant particles 36 is applied to the second topcoat 32. For ease of understanding, this mixture of particles is referred to as the "second" mixture because it is applied to the second topcoat, even though, in the method described here the second mixture is actually applied first in time. Furthermore, for clarity in the drawings, the second mixture will consist solely of optical elements 84 while the first mixture (applied to the first topcoat 30) will consist solely of skid-resistant particles 36. Those limitations should not be considered as limiting the scope of the invention in which the mixtures may comprise any variety of particles, optical or skid-resistant.

One method for applying the optical elements 34 and/or skid-resistant particles 36 is described in detail below and additional methods of applying optical elements are described in, for example, U.S. Pat. No. 4,988,555 to Hedblom, and U.S. patent application Ser. No. 08/296,677, filed on Aug. 26, 1994, titled PATTERNED CHALK-RESISTANT PAVEMENT MARKING, both of which are incorporated by reference.

After the first mixture of optical elements 34 is provided, the process of curing the second topcoat 30 is then begun which bonds the optical elements 34 to the second topcoat and reduces the ability of the second topcoat to accept and retain addition particles. Because the second topcoat is a thermosetting material, that curing process is carried out by the application of heat. The same heat simultaneously accomplishes the next step of preparing the first topcoat (a thermoplastic) to receive the skid-resistant particles 36 by heating and softening the thermoplastic material.

After the first topcoat 30 is sufficiently prepared, the first mixture, consisting primarily of skid-resistant particles 36 in the depicted embodiments can be deposited on the first topcoat 30 where they are bonded in place. It is preferred that the second topcoat is sufficiently cured and/or covered by the optical elements 34 to prevent any significant number of skid-resistant particles 36 from bonding to the second topcoat 32.

After the skid-resistant particles 36 are in position, the curing process can be completed to completely cure the second topcoat 32 and complete manufacturing of the pavement marking 10.

Figure 6A:
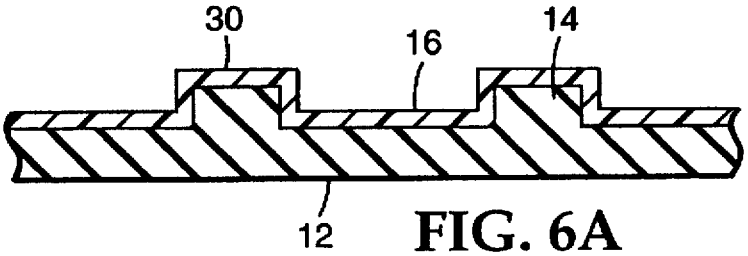
FIG. 6A is a simplified cross-sectional view of a base sheet/first topcoat laminate after embossing.

Some illustrative base sheet materials were described above. To some degree, the materials used for the base sheet 12 will influence the choice of materials for the first topcoat 30. Turning to FIG. 6A, a schematic cross-sectional view of the base sheet 12 and first topcoat 30 are depicted when properly formed after embossing to form the protuberances 14. As shown, it is preferred that the first topcoat 30 cover the protuberances 14 as well as the valley 16 between protuberances 14. It is essential that the valley 16 areas be covered, but some allowances can be made if the protuberances 14 are not covered by the first topcoat 30 as they can be covered later by the second topcoat 32.

Figure 6B:
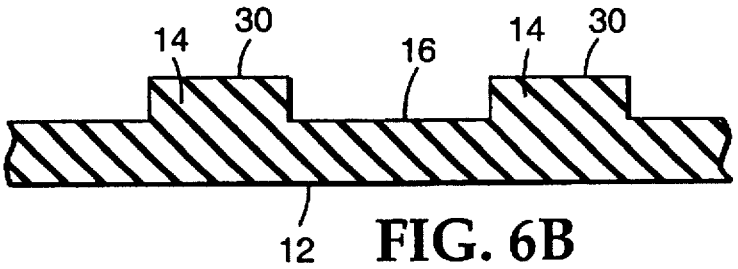
FIG. 6B is a simplified cross-sectional view of an alternate base sheet/first topcoat laminate after embossing.

FIG. 6B depicts a similar view of an undesirable product after the embossing step. As shown, the first topcoat material 30 is concentrated in the protuberances 14 and substantially absent from the valley 16 between the protuberances 14. The reason for this occurrence is a difference in viscosities between the materials used for the base sheet 12 and the first topcoat 30. The situation depicted in FIG. 6B can be avoided by properly controlling the viscosities of the base sheet 12 and the first topcoat 30.

Some illustrative examples of thermoplastic materials useful in conjunction with the present invention can be chosen from: ethylene acrylic acid (EAA) copolymers, ethylene methacrylic acid (EMAA) copolymers, polyethelyne (PE), ethylene copolymers, polypropylene (PP), ethylene-propylene-diene terpolymers (EPDM), polybutylene, ionically cross-linked ethylene methacrylic acid copolymer, ethylene n-butyl acrylate (EnBA), ethylene vinyl acetate (EVA), ethylene ethyl acrylate (EEA) copolymer, and ethylene methyl acrylate (EMA) copolymer.

Other suitable thermoplastic materials for securing the optical elements 34 and/or skid-resistant particles 36 to the pavement marking 10 are vinyl-based thermoplastic resins; see U.S. Pat. No. 4,117,192, incorporated herein by reference.

One illustrative example of a thermosetting material useful in conjunction with the present invention is a layer of polyurethane, preferably an aliphatic polyurethane. One useful polyurethane layer can be formed by first reacting two equivalents of methylene bis (4-cyclohexyl isocyanate) ($H_{12}MDI$) with one equivalent of a polycaprolactone triol polymer (a 2-oxypanone polymer with 2-ethyl-2-(hydroxymethyl)-1,3 propanediol) of molecular weight about 540 and hydroxyl number about 310 using dibutyltindilaurate as a catalyst. The reaction can be carrier out in ethyl-3-ethoxy propionate. NUODEX—believed to be an eight weight percent zinc 2-ethylhexanoate catalyst available from Huls America of New Jersey—may be added to the thermosetting layer mixture shortly before applying the layers to the base sheet. Inclusion of up to about 10 percent of 2,4 pentanedione in the mixture can extend the pot life of the mixture from about 1.5 hours to about 15 hours.

Another polyurethane that may be suitable for use as a thermosetting layer can include a polyurethane obtained by reacting a polycaprolactone triol polymer with an aliphatic polyisocyanate resin such as hexamethylene diisocyanate (HDI), for example, DESMODUR N-3200 from Miles. Illustrative examples of other materials that may be suitable for use as a thermosetting layer include: epoxies, preferably aliphatic epoxies such as hydrogenated bisphenol A epoxies and other aliphatic epoxies such as polyethylene glycol diglycidylether, combination polymers based on aliphatic epoxies and diols (any of the above-mentioned epoxies would normally be used with a crosslinker such as a multifunctional aliphatic amine, carboxylic acid, acid anhydride, mercaptan or polyol, but can undergo homopolymerization as well); acrylics such as sorbent coated solutions of common acrylic and methacrylic monomers with or without vinyl monomers; a wide variety of weathering stable, liquid applied coatings systems including but not limited to acrylated and/or methacrylated oligomers, urea-formaldehyde and melamine-formaldehyde based crosslinking systems, polyesters, and polyaziridine/carboxylic acid systems.

Some thermosetting layer materials may be somewhat effective as clear resins, but virtually all would benefit from the use of appropriate UV stabilizers and/or a pigmentation system.

UV stabilizers—such as UV absorbers, hindered amines, nickel chelates, hindered phenols, and aryl esters—can be added to the thermosetting layer. Examples of UV stabilizers are disclosed in Kirk-Othnaer, Encyl. Chem. Tech., pp. 615–627, v. 23, (3d. Ed. 1983). Additionally, colored pigments can be added to the thermosetting layer mixture to further protect the underlying base sheet and to enhance the color of the pavement marking (that is, match the base sheet's color). The colored pigments can be added to a polyurethane layer mixture in the form of a dispersion. Useful ranges of pigment dispersion which may be included are 10–30 parts per 25 parts of urethane prepolymer. The colored pigments, generally, are present in the barrier layer at 1 to 40 percent based on the weight of the thermosetting layer. Useful colored pigments may include those cited above for use in the base sheet, and any other colored pigments typically used for coloring pavement markings also may be used.

Other suitable thermosetting materials include two-part polyurethanes formed by reacting polycaprolactone diols and triols with derivatives of hexamethylene diisocyanate; epoxy based resins as described in U.S. Pat. Nos. 4,248,932, 3,436,359, and 3,580,887; and blocked polyurethane compositions as described in U.S. Pat. No. 4,530,859.

The thermosetting material also may contain the UV stabilizers and colored pigments cited above. The material can be colored to match the color of the base sheet and the thermoplastic material. The UV stabilizers and colored pigments may be incorporated into the thermosetting material as taught in the Hedblom patents, the disclosures of which are incorporated here by reference.

Figure 7:
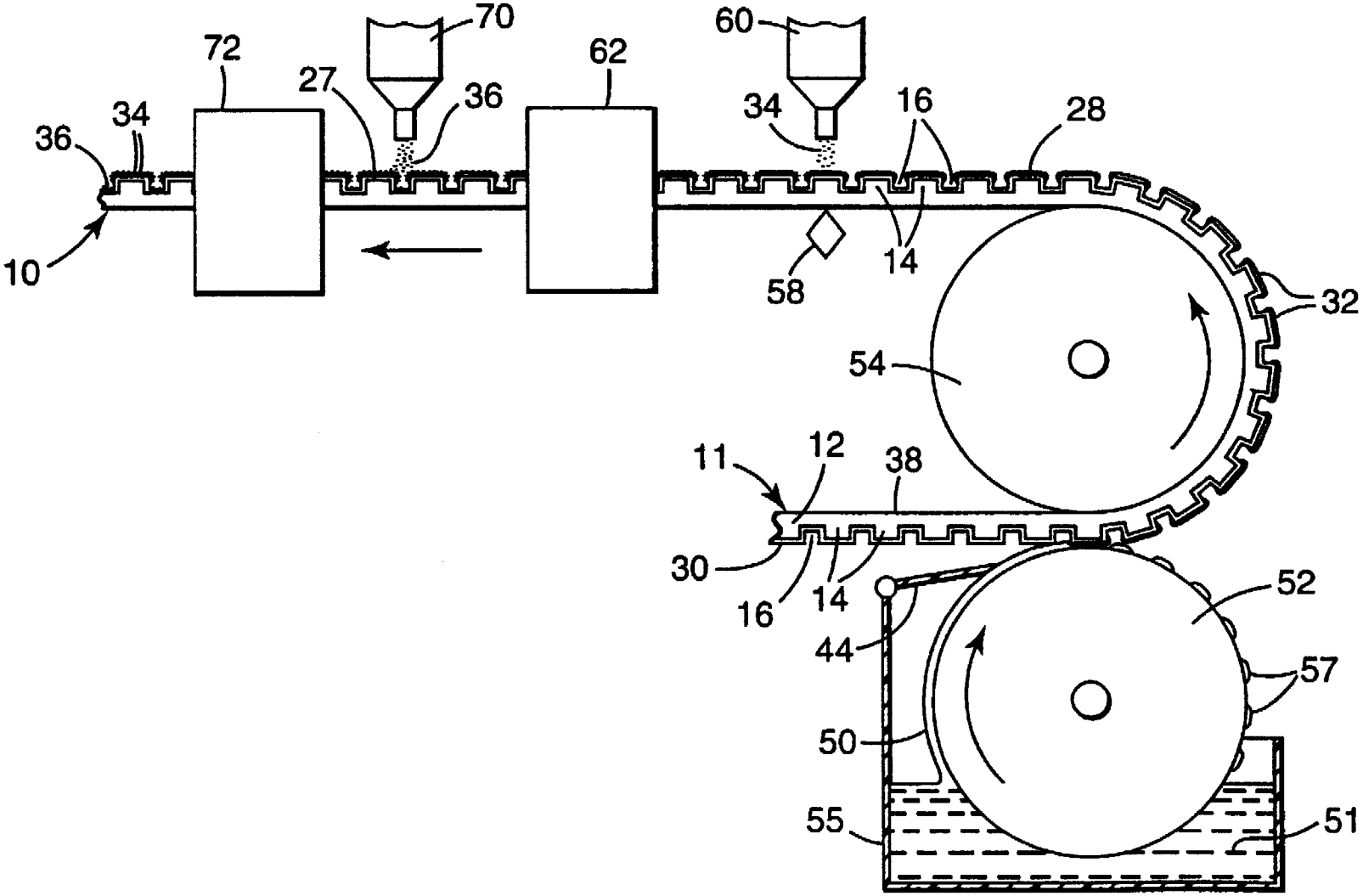
FIG. 7 schematically illustrates one method of making a pavement marking 10 in accordance with the present invention.

Retroreflective pavement markings according to the present invention can be made in accordance with the method illustrated in FIG. 7. That method is preferably carded out continuously by the sequential steps listed and described in conjunction with FIG. 5 above. Those steps are largely depicted schematically in FIG. 7.

The laminate 11 comprising the base sheet 12 and first topcoat 30 can be provided in accordance with known procedures; see U.S. Pat. Nos. 4,117,192 and 5,194,113, both of which are incorporated by reference.

Briefly, however, one illustrative process of making the base sheet 12 and first topcoat 30 may include the steps of providing a casting roller with a cooled surface and an accompanying nip roller. The base sheet 12 is fed through the nip. Next, the first topcoat layer 30, comprising a thermoplastic material in one embodiment, is melt extruded onto the base sheet 12 material to form the laminate 11 depicted in FIG. 7.

In an alternative embodiment, the process of forming a laminate 11 may include a suitable adhesive or other "tie" layer interposed between the base sheet 12 and the first topcoat 30 as a means of improving the bond between those two layers. The use of a tie layer is particularly advantageous in cases where the first topcoat 30 layer and base sheet 12 comprise especially dissimilar materials. In such cases, the two layers may be difficult to bond to one another. Choice of an appropriate tie layer having a proper affinity toward both materials (i.e., those of the first topcoat 30 and the base sheet 12), can provide an effective enhancement of the bond between the two layers.

In any event, the laminate 11 formed by the base sheet 12 and first topcoat 30 is then embossed to form the desired protuberances 14 separated by valley 16. The lamination and embossing steps are not depicted in FIG. 7. Alternatively (as described above with regard to FIG. 5), the base sheet 12 may be formed and embossed before the first topcoat 30 is laminated to the base sheet 12. This process may avoid potential problems involved in embossing the dissimilar materials in the base sheet 12 and the first topcoat 30.

The third step of the process depicted in FIG. 7 involves applying the second topcoat material 32 to the protuberances 14 formed in the laminate. As depicted, the laminate 11 is oriented with the protuberances 14 projecting downward and the second major surface or back side 38 oriented upward. The protuberances 14 contact a film 50 of liquid second topcoat material 51 on a print roller 52. Print roller 52 receives the film 50 of liquid second topcoat material 51 by being first immersed in a reservoir 55 of liquid second topcoat material 51. Print roller 52 preferably has a hard outer surface (e.g., of steel) to enable the liquid second topcoat material 51 to be selectively applied to the protuberances 14. A backing roller 54 contacts the back surface 38 of base sheet 12 to advance the laminate 11 by rotating counterclockwise in the direction of the arrow. As the laminate 11 advances, print roller 52 passes through the reservoir 55 of liquid second topcoat material 51 to form the film 50 on the print roller 52. A doctor blade or notch bar 44 may be used to meter the film 50 to a desired thickness. As the rotation continues, the film 50 contacts the protuberances 14. As protuberances 14 contact film 50, a discontinuous layer 32 of bonding material is applied to or printed on protuberances 14. Non-adhering portions 57 of film 50 return to the reservoir 55 on the print roller 52.

Several factors affect transfer of liquid second topcoat material 51 onto laminate 11. These factors may include nip pressure, hardness of print roller 52, hardness of backing roller 54, viscosity of the liquid second topcoat material 51, speed of laminate 11, and speed of rotation of backing roller 54 relative to print roller 52. Furthermore, the process depicted in FIG. 7 provides a coating of the second topcoat material 51 over the entire protuberance 14. As described in conjunction with the embodiments depicted in FIGS. 3 and 4, it may be desirable to apply the material 51 over only the side surfaces of the protuberances 14 or even over only a portion of the side surfaces. These variables may be adjusted as desired and are discussed at length in the Hedblom patents.

In carrying out the fourth step of the method, the laminate 11 is inverted after the layer 32 of second topcoat material has been applied to the protuberances 14. The second mixture of particles, comprising primarily optical elements 34 as discussed above, is then applied and become partially embedded in the still fluid layer 32 of second topcoat material.

The optical elements 34 may be applied by a flood coating process which results in a dense packing of the optical elements 34 on the second topcoat. This can be accomplished by dropping the optical elements 34 from a hopper 60 onto the top surface 28. A vibrator 58 such as a rotating bar can be disposed beneath the laminate 11 to cause the particles in the "second" mixture (all optical elements 34 in this example) which fall into the valley 16 to bounce up on the layer 32 of second topcoat material on the protuberances 14. Alternatively, the optical elements 34 may be sprinkled or cascaded upon the base sheet 12, such that a dense packing is avoided. The sprinkling process may be advantageous for decreasing optical element usage and for decreasing dirt retention between optical elements 34.

After the optical elements 34 are partially embedded in the second topcoat material, the process of curing the second topcoat material is begun to retain the optical elements 34 in a secured position in the layer 32 of the second topcoat material on the protuberances 14. As indicated above, the preferred second topcoat is a thermosetting material and, as a result, heat from oven 62 provides temperatures sufficient to begin the curing process. Upon leaving the oven 62, a vacuum (not shown) can be employed to gather unsecured optical elements 34 and skid-resistant particles 36 for recycling.

The temperature and dwell time in oven 62, is preferably sufficient to prepare the thermoplastic layer provided as the first topcoat 30 to receive and retain skid-resistant particles 36 within the valley 16 between protuberances 14. In one process, oven 69, is held at approximately 120° C. or higher and web speed is controlled such that a given point on the web remains with oven 62 for a period of about 1–5 minutes. Temperature and dwell time are, of course, determined based on the curing characteristics of the second topcoat material 32 as well as the properties of the thermoplastic material used for the first topcoat 30 as described below. As a result, the temperature and dwell time will vary based on the choice of materials.

Other methods of applying optical elements 34 and/or skid-resistant particles 36 to a thermosetting material can be found in U.S. Pat. No. 3,451,537, incorporated herein by reference.

Furthermore, although an oven 62 is disclosed for use in one method according to the present invention, it will be understood that heated rollers or other heat transfer methods and apparatus may also be used to cure the thermosetting material used to bond optical elements 34 and/or skid-resistant particles 36 to pavement markings according to the present invention. A variety of such methods are described in U.S. Pat. No. 5,194,113 which is incorporated by reference.

In the method depicted in FIG. 7, after the laminate 11 has travelled through oven 62, the exposed first topcoat material 30, which is at least located in the valley 16 and possibly located on a portion of the side surfaces and/or the top surfaces 27 of the protuberances 14, will be capable of receiving and retaining the "first" mixture of particles from hopper 70. As discussed above with regard to FIG. 5, the depicted first mixture dispensed from hopper 70 comprises only skid-resistant particles 36 although any other combination or particles may be dispensed there.

The exact methods used to deliver particles 36 may include flood coating, sprinkling, cascading, etc. and the exact method will depend on many factors including particle size, viscosity of the first topcoat 30, web speed and others. As with the second mixture of optical elements 34 depicted in FIG. 7, a vacuum system may be used to remove excess particles and a beater bar or other vibration device may be helpful to uniformly distribute skid-resistant particles 36, especially when it is desired to place particles 36 on the top surfaces 27 of the protuberances 14.

If necessary to complete curing of the second topcoat layer 32, one or more additional ovens 72 may be provided to further heat the pavement marking 10. Those skilled in the art will understand that although ovens 62 and 72 are depicted as separate in FIG. 6, they may also be provided as "zones" in a multi-zone oven in which case hopper 70 may actually be located within the oven.

It will be understood that, in place of the oven 62 used to begin curing of the second topcoat 32, the first topcoat 30 may also be softened by the use of one or more heated rollers as described in U.S. Pat. No. 5,194,113.

The preferred conditions of temperature and time for embedding are those that are sufficient to obtain desired particle (bead) embedment (e.g., typically between about 40–70%). Appropriate adjustment of time and temperature in this process is within the skill of the art for the materials described above.

Although the descriptions above have focused on laminates 11 in which the first topcoat 30 covers the entire top surface of the base sheet 12, it will be understood that alternately, the first topcoat 30 may not be located on the surfaces of the protuberances 14. Methods of applying the first topcoat 30 in the valley 16 and not on the protuberances 14 will be known to those skilled in the art. They may include displacing the first topcoat 30 from the protuberances 14 during embossing or simply laminating a discontinuous first topcoat 30 which includes voids in the appropriate pattern for the protuberances 14.

Furthermore, although the descriptions above have been focused on the use of thermoset and thermoplastic materials in combination for the multiple topcoats used in pavement markings according to the present invention, it will be understood that many different combinations of materials could be used.

One alternate variation on the pavement markings and methods of manufacturing them may include the use of two layers of a thermosetting material for the first and second topcoats 30 and 32. In such a variation, the topcoats could be sequentially applied, loaded with a desired particle (optical or skid-resistant) and cured. In other words, the first topcoat layer would be applied and the loaded with skid-resistant particles after which it would be at least partially cured. Following that, the second topcoat layer could be applied, loaded with optical elements and then a final curing process could be carried out which would completely cure both thermosetting topcoats. A potential disadvantage of this variation is that thermosetting materials are typically stiffer than thermoplastics and, as a result, may provide a less-compliant pavement marking which may not adhere to a roadway as well as a more compliant pavement marking.

Another variation may include the use of two thermoplastic layers, each having different properties such that their viscosity could be controlled to allow the placement of skid-resistant particles in one area where a first thermoplastic material is located. Following that, the temperature of the pavement marking could be raised still higher, allowing placement of the optical elements in desired areas where the second (higher temperature) thermoplastic was located. To avoid wasting the optical elements, it would be desirable to ensure complete coverage of the first thermoplastic layer with the skid-resistant particles, thereby preventing attachment of optical elements to the first thermoplastic.

Yet other variations may involve the use of moisture-curable, UV-curable, two-part reaction systems, curing systems involving catalysts and other variations. Furthermore, although the illustrative examples described in detail above rely on differing properties of topcoat materials in relation to thermal energy, in some instances it may be advantageous to provide topcoat materials on the same pavement marking which cure based on different properties, e.g., a UV-curable resin in combination with a thermosetting or thermoplastic material, a moisture-curable materials in combination with a UV-curable resin and a thermoplastic, etc. The various combinations will be known to those skilled in the art.

The following example illustrates features, advantages, and other details of the invention. It is to be expressly understood, however, that while the example serves this purpose, the particular ingredients and amounts used as well as other conditions and details are not to be construed in a manner that would unduly limit the scope of this invention.

EXAMPLE

Preparation of Components

To form a white base sheet material, the ingredients in Table 1 were mixed in a Banbury internal mixer where they reached an internal temperature of approximately 150° C. The material was then cooled on a rubber mill and calandered into a sheet about 1.4 mm thick.

| COMPONENT | PARTS |
|---|---|
| Acrylonitrile-butadiene non-crosslinked elastomer precursor (PARACIL ™ B supplied by Uniroyal Chemical) | 100 |
| Talc platelet filler particles averaging 2 micrometers in size (MISTRON SUPERFROST ™ supplied by Luzenac America, Inc.) | 100 |
| 3 denier polyester filament 0.6 centimeter (1/4 inch) long (SHORT STUFF ™ supplied by Mini Fibers, Inc.) | 10 |
| FIbers of high-density polyethylene having a molecular | 20 |

-continued

| COMPONENT | PARTS |
|---|---|
| weight ranging between 30,000 and 150,000 (FYBREL ™ supplied by Mini Fibers, Inc.) | |
| Phenol type anti-oxidant (SANTO WHITE ™ crystals supplied by Monsanto Co.) | 1 |
| Chlorinated paraffin (CHLOREZ ™ 700S supplied by Dover Chemical Corp.) | 70.0 |
| Spherical silica reinforcing filler (HISIL ™ 233 supplied by PPG Industries) | 20 |
| Stearic Acid processing aide | 3.5 |
| Chlorinated paraffin (PAROIL 140LV supplied by DOver Chemical Corp.) | 5.0 |
| Chelator (VANSTAY ™ SC supplied by Vanderbilt) | 0.5 |
| Ultramarine Blue (supplied by Whittacker, Clark & Daniels, INC., Willowbrook, Illinois) | 0.5 |
| Rutile titanium dioxide pigment (TIPURE ™ R-960 supplied by Dupont) | 130 |
| Transparent glass microspheres averaging about 100 micrometers in diameter and having an index of refraction of 1.5 | 280 |
| TOTAL | 740.5 |

A urethane prepolymer was manufactured by reacting two equivalents of methylene bis (4-cyclohexyl isocyanate ($H_{12}MDI$)) with one equivalent of a polycaprolactone triol (i.e., a 2-oxypanone polymer with 2-ethyl-2-(hydroxymethyl)1,3-propanediol) of molecular weight about 540 and hydroxyl number about 310 using dibutyltindilaurate as a catalyst. The reaction was carried out in ethyl-3-ethoxy propionate. After the reaction, the polymer was further diluted with 2,4 pentanedione to aide in potlife stability. The final prepolymer solution contained approximately 50 percent by weight urethane prepolymer, and 10 percent by weight 2,4 pentanedione. To this 100 grams of this solution was added 21.4 grams of Fine Pearl pigment purchased from The Mearl Corporation of Briarcliff Manor, New York.

A thermoplastic topcoat was prepared by extruding a precolor resin purchased from PMS Consolidated of Elk Grove Village, Ill. The precolor resin consists of 3.8 percent Pigment White #6, 13.4 percent Pigment Yellow #191, and 82.8 percent Nucrel 699 (an EMAA copolymer available from E.I. Dupont de Nemours, Wilmington, Del.). The precolor resin was extruded to a thickness of approximately 0.1 mm.

The thermoplastic topcoat previously prepared was laminated to the rubber base sheet. This laminate was then heated to approximately 135° C. and embossed to produce a patterned base sheet with transverse protuberances measuring approximately 1.3 mm in height and 13 mm in width with a valley spacing of approximately 13 mm. Visually it was evident that there remained a substantial mount of thermoplastic topcoat in the valley sections of the patterned material.

The pigmented polyurethane resin was coated onto a release liner using a notch bar coster set at approximately a bar gap of 0.75 mm. The patterned base sheet with the first topcoat was inverted and the raised protuberances pressed into the liquid polyurethane resin. The base sheet was then peeled off the polyurethane and 1.93 index of refraction ceramic beads were cascaded onto the patterned side of the base sheet. After cascading the beads the back of the sample was vibrated to remove excess beads from the valleys.

The sample was then placed in an oven at approximately 120° C. for 5 minutes to begin the curing the polyurethane and to begin softening the thermoplastic topcoat. The sample was then removed from the oven and ceramic skid particles were then sprinkled onto the top of the product. The sample was returned to an oven at approximately 150° C. for ten minutes and then removed.

The finished sample was inspected visually. The material reflected brilliantly white when illuminated with a flashlight. The polyurethane topcoat remained nominally 99 percent free of ceramic skid particles, while the valleys remained nominally 100 percent free of ceramic beads. The valleys of the product remained yellow when viewed in daylight.

This invention may take on various modifications and alterations without departing from the scope thereof. Accordingly, it is to be understood that this invention is not to be limited to the above-described, but is to be controlled by the limitations set forth in the following claims and any equivalents thereof.

What is claimed is:

1. A pavement marking comprising:

(a) a base sheet having first and second major surfaces, the first major surface having a plurality of protuberances located thereon, the protuberances being separated by a valley;

(b) a first topcoat attached to the first major surface of the base sheet, the first topcoat being located at least in the valley;

(c) a second topcoat selectively located on the protuberances so as to be substantially absent from the valley; and (d) a first mixture of optical elements and/or skid-resistant particles partially embedded in the first topcoat; and (e) a second mixture of optical elements and/or skid-resistant particles partially embedded in the second topcoat.

2. A pavement marking according to claim 1, wherein the first mixture is substantially free of optical elements.

3. A pavement marking according to claim 1, wherein the second mixture is substantially free of skid-resistant particles.

4. A pavement marking according to claim 1, wherein each of the plurality of protuberances comprises a top surface and a side surface connecting the top surface to the valleys, and further wherein the second topcoat substantially covers all of the top and side surfaces of each of the plurality of protuberances.

5. A pavement marking according to claim 1, wherein each of the plurality of protuberances comprises a top surface and a side surface connecting the top surface to the valley, further wherein the second topcoat substantially covers all of the side surface of each of the plurality of protuberances, and yet further wherein the second topcoat is substantially absent from the top surface of each of the plurality of protuberances.

6. A pavement marking according to claim 1, wherein each of the plurality of protuberances comprises a top surface and a side surface connecting the top surface to the valley, and further wherein the second topcoat substantially covers only a portion of the side surface area of each of the plurality of protuberances, wherein the second topcoat is visible from a first direction and not visible from a direction opposite from the first direction.

7. A pavement marking according to claim 6, wherein the first topcoat exhibits a first color and the second topcoat exhibits a second color.

8. A pavement marking according to claim 7, wherein the first and second mixtures each comprise retroreflective optical elements, and further wherein the pavement marking retroreflects the first color in the first direction and the second color in the second direction.

9. A pavement marking according to claim 1, wherein the first topcoat is a thermoplastic.

10. A pavement marking according to claim 9, wherein the first topcoat is selected from the group consisting of ethylene acrylic acid (EAA) copolymers, ethylene methacrylic acid (EMAA) copolymers, polyethylene (PE), ethylene copolymers, polypropylene (PP), ethylene-propylene-diene terpolymers (EPDM), polybutylene, ionically cross-linked ethylene methacrylic acid copolymer, ethylene n-butyl acrylate (EnBA), ethylene vinyl acetate (EVA), ethylene ethyl acrylate (EEA) copolymer, and ethylene methyl acrylate (EMA) copolymer.

11. A pavement marking material according to claim 9, wherein the second topcoat is a thermosetting material.

12. A pavement marking material according to claim 11, wherein the thermosetting material is a urethane.

13. A pavement marking according to claim 12, wherein the urethane is an aliphatic polyurethane.

14. A pavement marking according to claim 13, wherein the polyurethane is formed by reacting a polycaprolactone triol polymer with an aliphatic polyisocyanate resin.

15. A pavement marking according to claim 1, wherein the second topcoat is selected from the group consisting of polyurethanes, epoxies, acrylics, acrylated or methacrylated oligomers, urea-formaldehyde and melamine-formaldehyde based crosslinking systems, polyesters, polyaziridine/carboxylic acid systems, and combinations thereof.

16. A pavement marking according to claim 1, wherein at least one of the first and second topcoats contains pigments, UV stabilizers, or combinations thereof.

17. A pavement marking comprising:

(a) a base sheet having first and second major surfaces, the first major surface having a plurality of protuberances located thereon, the protuberances being separated by a valley;

(b) a first topcoat attached to the first major surface of the base sheet, the first topcoat being located at least in the valley and the first topcoat comprising a thermoplastic material;

(c) a second topcoat selectively located on the protuberances so as to be substantially absent from the valley, the second topcoat comprising a thermosetting material; and (d) a first mixture of optical elements and/or skid-resistant particles partially embedded in the first topcoat, the first mixture comprising at least a majority of skid-resistant particles; and (e) a second mixture of optical elements and/or skid-resistant particles partially embedded in the second topcoat, the second mixture comprising at least a majority of optical elements.

18. A pavement marking comprising:

(a) a base sheet having first and second major surfaces, the first major surface having a plurality of protuberances located thereon, the protuberances being separated by a valley;

(b) a first topcoat attached to the first major surface of the base sheet, the first topcoat forming a substantially continuous layer on the first major surface of the base sheet;

(c) a second topcoat selectively located on the protuberances go as to be substantially absent from the valley; and (d) a first mixture of optical elements and/or skid-resistant particles partially embedded in the first topcoat; and (e) a second mixture of optical elements and/or skid-resistant particles partially embedded in the second topcoat.

19. A pavement marking according to claim 18, wherein the first mixture is substantially free of optical elements.

20. A pavement marking according to claim 18, wherein the second mixture is substantially free of skid-resistant particles.

21. A pavement marking according to claim 18, wherein the first topcoat is a thermoplastic.

22. A pavement marking material according to claim 21, wherein the second topcoat is a thermosetting material.

23. A pavement marking according to claim 18, wherein the first topcoats contains pigments, UV stabilizers, or combinations thereof.

* * * * *